United States Patent [19]

Van Ike

[11] 4,033,048

[45] July 5, 1977

[54] FREEZE DRYING APPARATUS

[76] Inventor: Clayton Van Ike, 9264 Rockacres Drive, Lakeside, Calif. 92040

[22] Filed: Jan. 12, 1976

[21] Appl. No.: 648,094

[52] U.S. Cl. ..... 34/92; 34/5

[51] Int. Cl.[2] ..... F26B 13/30; F26B 5/06

[58] Field of Search ..... 34/4, 5, 15, 92

[56] References Cited

UNITED STATES PATENTS

| | | | |
|---|---|---|---|
| 2,751,687 | 6/1956 | Colton | 34/5 |
| 3,020,645 | 2/1962 | Copson | 34/15 |
| 3,362,835 | 1/1968 | Thuse et al. | 34/5 X |
| 3,633,283 | 1/1972 | Mishkin et al. | 34/5 X |
| 3,740,860 | 6/1973 | Smith, Jr. | 34/5 |

*Primary Examiner*—John J. Camby
*Attorney, Agent, or Firm*—Brown & Martin

[57] ABSTRACT

Freeze drying apparatus in which a liquid product is sprayed into a freezing chamber to produce a frozen powder, which drops on to a multiple stage conveyor in a drying chamber under vacuum. The drying chamber is open to the freezing chamber and is also maintained at freezing temperature. The moisture content of the frozen powder is sublimated by microwave radiation, which does not heat the chamber or the conveyors and causes minimal temperature increase of the powder. The dry powder is carried on a further conveyor, through a microwave excluding choke, to a collection chamber. Cold water vapor is constantly removed from the drying chamber by the vacuum pump and condensed in a heat exchanger, from which the resultant ice is removed by microwave radiation to minimize temperature variations in the system.

3 Claims, 5 Drawing Figures

FREEZE DRYING APPARATUS

BACKGROUND OF THE INVENTION

In most conventional techniques of freeze drying, the product is frozen into powder or flake form and transported through a heating chamber to remove the moisture. When using direct heat, the chamber and all its contained structure becomes heated and the product may be damaged by partial melting or surface crusting, and much flavor is often lost due to chemical changes caused by the heating. As a result, it is impractical to freeze dry certain products by the heat method. Further, the process is lengthy and may take from eight to twelve hours or even longer, to produce a batch of powdered product. Often the apparatus must be shut down after a batch is completed, in order to remove the product and service the apparatus for subsequent use.

Moisture removal has also been a problem and condensors require frequent servicing for ice removal. In some systems, the process must be stopped to remove ice and return the heat exchange equipment to the proper temperature balance.

The process is thus complex and expensive and it is economically impractical to utilize freeze drying for a wide variety of products. Since many products which normally have a limited shelf life, or are bulky to store, could be stored easily for extended periods in dry powder form, a low cost and rapid freeze drying technique would be very desirable.

SUMMARY OF THE INVENTION

The freeze drying apparatus described herein is capable of drying a variety of products, particularly food products, rapidly and continuously at low cost. The process is accomplished in about twenty to thirty minutes, compared to the usual eight to twelve hours, and the apparatus does not require frequent shutting down for servicing.

The product in liquid form is sprayed into a freezing chamber and becomes a snow-like powder which falls on to a series of stacked conveyors in a drying chamber. The drying chamber is open to and forms an extension of the freezing chamber, the entire space being maintained at a freezing temperature. The conveyors carry the fine particles back and forth while the chamber is irradiated with microwave radiation. This heats the particles evenly but does not heat the chamber or conveyor structure. By controlling the microwave power, the moisture can be sublimated from the particles while the particles remain cold, thus avoiding chemical and physical changes which cause loss of flavor and affect the consistency of the product. The dried product is carried from the drying chamber into a collection chamber, on a conveyor which passes through a microwave excluding choke to prevent leakage of the microwave energy.

The entire interior of the apparatus is maintained under continuous vacuum by a pump, which draws off the cold water vapor from the drying chamber before it collects on the interior surfaces. This, together with the microwave radiation, keeps the interior of the apparatus frost free and allows continuous operation without servicing. The vacuum also prevents oxidation of the product, which could affect the flavor. The cold water vapor drawn off by the vacuum system is passed through a heat exchanger over pipes carrying the circulating refrigerant used to cool the freezing chamber.

Water condenses out of the vapor and forms ice, which is preferably disposed of by microwave radiation in the heat exchanger. This melts the ice without appreciably heating the structure and enables the apparatus to continue functioning with minimum disturbance of the temperature balance. If necessary, two heat exchangers can be used in parallel, so that one can be defrosted while the other is in operation.

The finished product can be removed from the collection chamber in batches, or, for high capacity production, can be delivered through a vacuum trap as it is collected.

The primary object of this invention, therefore, is to provide new and improved freeze drying apparatus.

Another object of this invention is to provide freeze drying apparatus which produces a dried product rapidly and continuously with minimum servicing.

Another object of the invention is to provide freeze drying apparatus which does not heat the product sufficiently to cause undesirable chemical and physical changes in the product.

A further object of this invention is to provide freeze drying apparatus in which drying is accomplished by microwave energy in a vacuum chamber.

Another object of the invention is to provide freeze drying apparatus in which the optimum temperature balance can be maintained for prolonged periods of operation.

These and other objects and advantages will be apparent in the following detailed description, taken in conjunction with the accompanying drawings, in which.

DESCRIPTION OF THE PREFERRED EMBODIMENT

Figure 1:
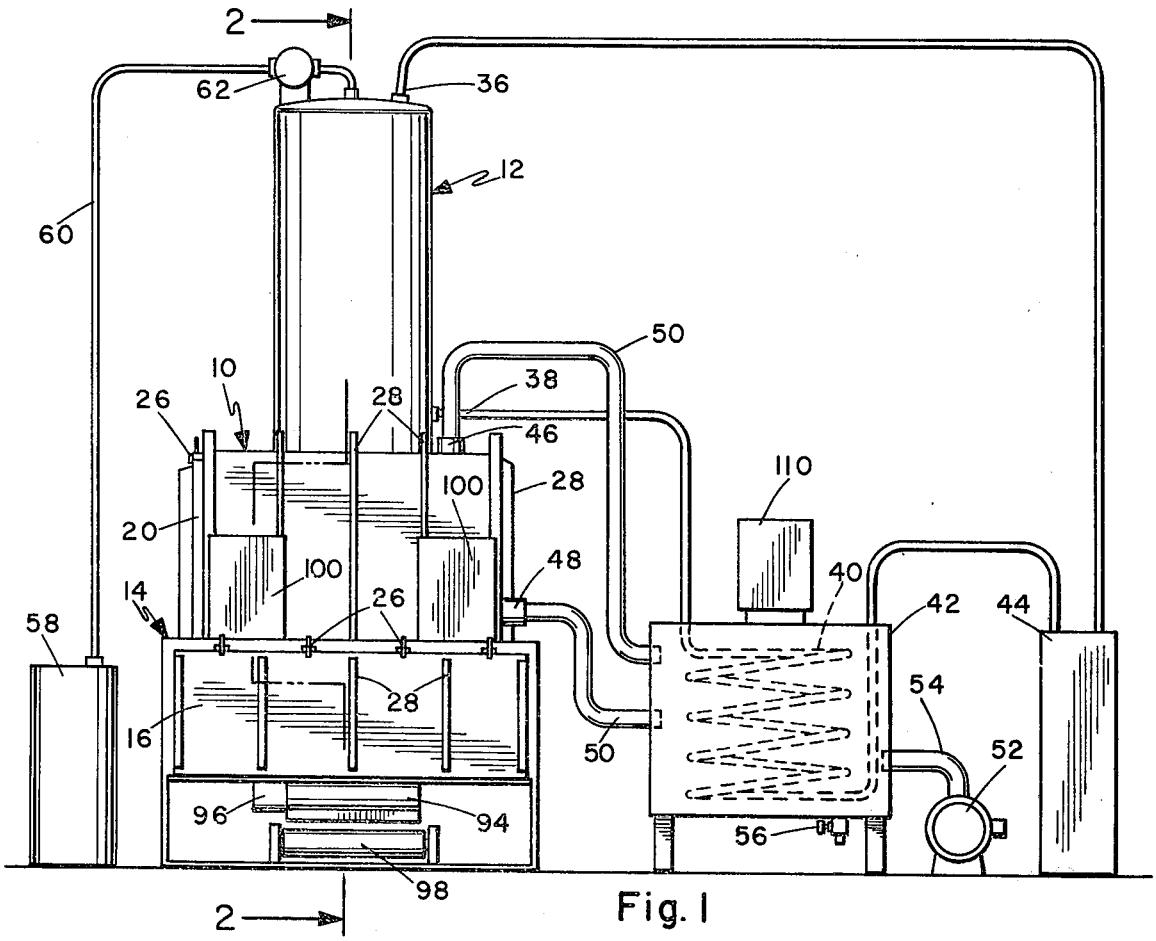
FIG. 1 is a side elevation view of the complete apparatus.
Figure 4:
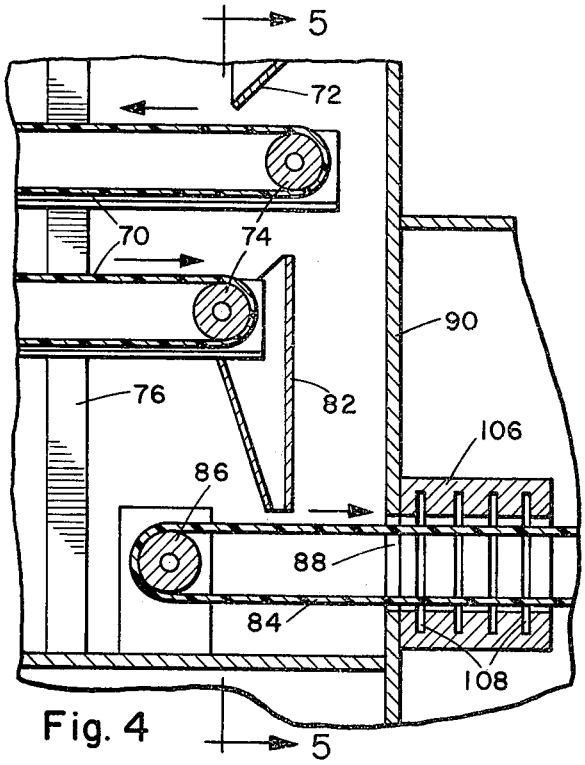
FIG. 4 is a further enlarged sectional view similar to a portion of FIG. 2.
Figure 5:
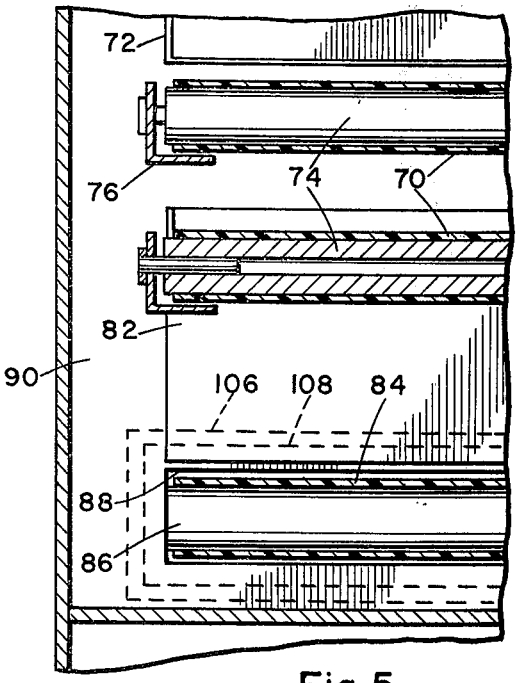
FIG. 5 is a sectional view taken on line 5—5 of FIG. 4.

The apparatus, as illustrated in FIG. 1, includes a drying chamber 10 on top of which is a vertical freezing chamber 12. On one side of drying chamber 10 is a collection chamber 14, having an access door 16 mounted on a hinge 18. Drying chamber 10 has a door 20 mounted on a hinge 22, both doors being provided with seals 24 to hold a vacuum and being secured by suitable clamps means, such as toggle clamps 26. The drying and collection chambers are illustrated as being of rectangular box construction, reinforced as necessary, by ribs 28 to withstand atmospheric pressure when the interior is under vacuum. However, the specific configuration and structure may vary to suit requirements.

The freezing chamber 12 comprises an inner cylinder 30 and an outer cylinder 32, enclosing an annular cooling jacket 34. Refrigerant is supplied through a supply line 36 in the top of outer cylinder 32, and exhausts through a return line 38 at the lower end. The refrigerant is carried through coils 40 in a heat exchanger 42 and through a conventional refrigeration unit 44, in a closed circulatory system, the general arrangement being well known.

Drying chamber 10 has two vacuum outlets to ensure adequate removal of water vapor, one outlet 46 being in the top portion of the chamber at one side and the other outlet 48 in the lower portion toward the other side. Both vacuum outlets are coupled by extraction pipes 50 to one side of the heat exchanger 42. A vacuum pump 52 draws vacuum through an exhaust line 54 at the other side of heat exchanger 42, so that the vapor drawn from the drying chamber passes over refrigerant coils 40. A drain 56 is installed in the heat exchanger for removal of accumulated water.

Figure 2:
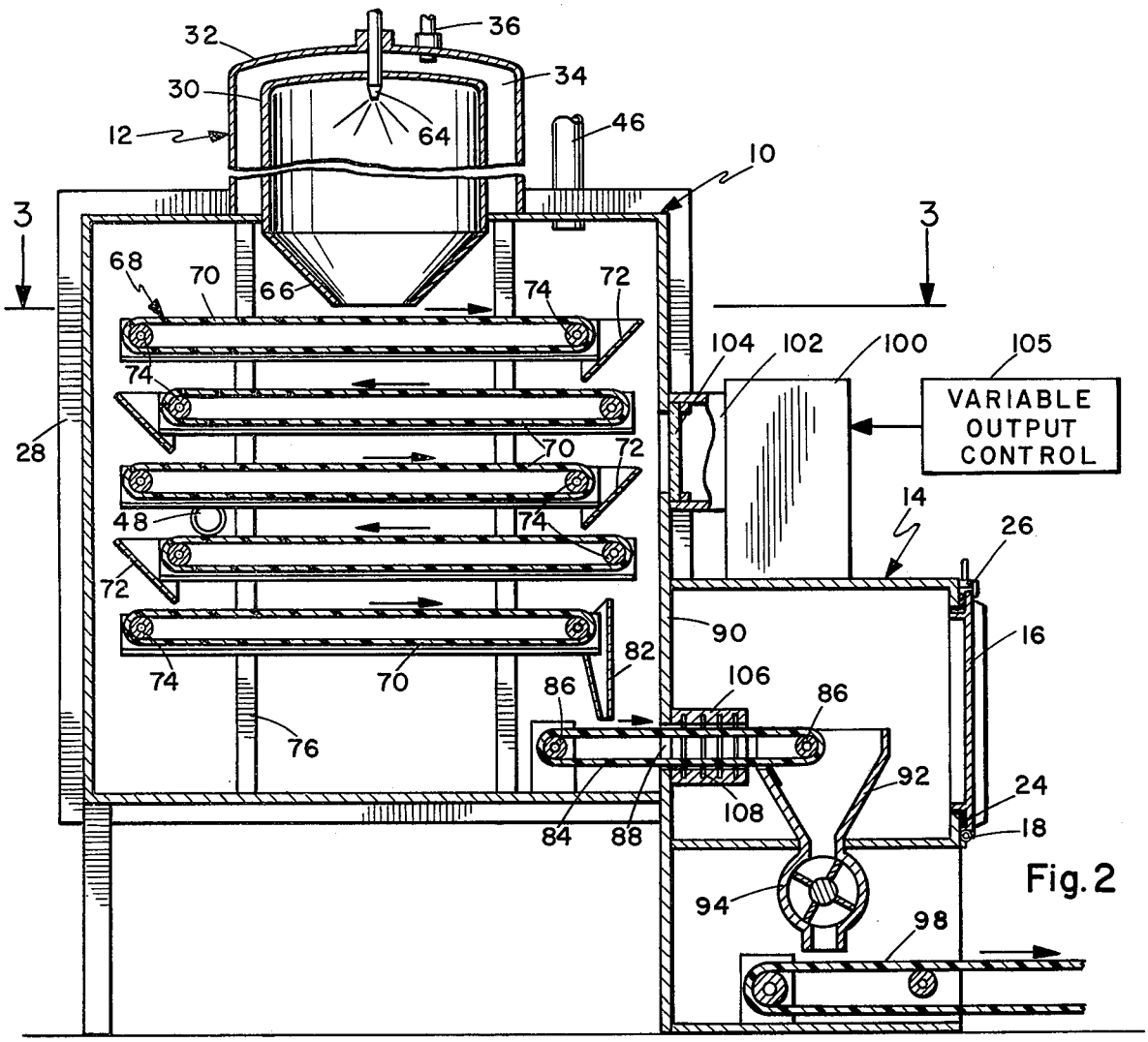
FIG. 2 is an enlarged sectional view taken on line 2—2 of FIG. 1.

The product to be dried is held in a supply container 58 and is drawn through a line 60 by a pump 62, and ejected through a nozzle 64 into the interior of freezing chamber 12, as in FIG. 2. Nozzle 64 creates a fine spray or mist which is instantly frozen and falls as snow-like powder to a funnel 66 at the lower end of the freezing chamber. Funnel 66 deposits the frozen powder on to a conveyor assembly 68 in the drying chamber 10. The drying chamber 10 is open to the freezing chamber 12 and forms, in effect, a continuous chamber in which the freezing temperature is maintained.

Figure 3:
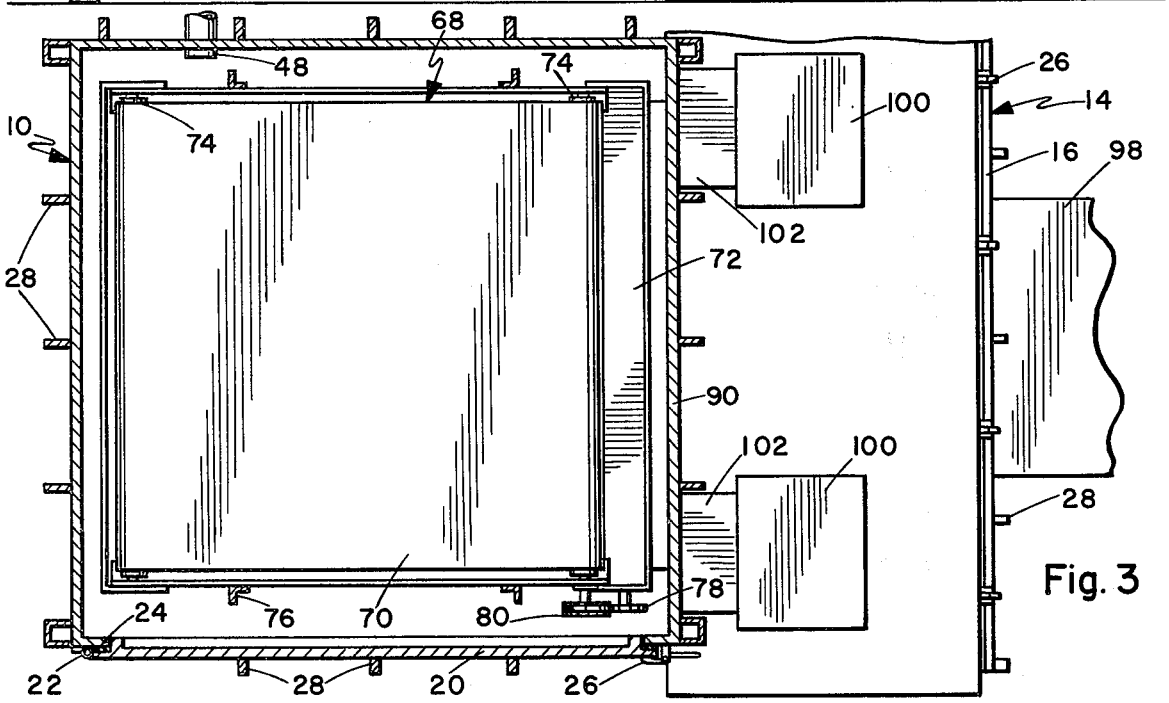
FIG. 3 is a sectional view taken on line 3—3 of FIG. 2.

The conveyor assembly 68 comprises a series of similar closed loop belts 70 vertically stacked and alternately staggered longitudinally. At one end of each belt is a deflector plate 72 which guides the powder to the next lower belt. The belts are suspended between pairs of rollers 74 mounted in a suitable supporting frame 76 and are preferably driven at equal speed by a common motor, not shown. Any suitable means may be used to drive the belts alternately in opposite directions. One well known arrangement, indicated in FIG. 3, utilizes a sprocket 78 attached to the roller 74 at one end of each belt, and a drive chain 80 threaded around the sprockets on alternate sides to drive all belts simultaneously. The powder is thus carried back and forth across the drying chamber and is deposited into a chute 82 at the downstream end of the lowermost belt 70.

Chute 82 opens on to a collection conveyor belt 84 suspended between rollers 86, and preferably coupled to the common drive means for conveyor assembly 68. Collection conveyor belt 84 extends through a slot 88 in the side wall 90 of drying chamber 10 and into the collection chamber 14. The dried product may be dumped into a hopper and removed in batches through door 16. However, for continuous production, the hopper 92 preferably opens to a rotary vacuum trap 94 of well known configuration, driven by a motor 96. The product is thus removed from the apparatus without loss of vacuum and is deposited on a delivery conveyor 98 for delivery to a packaging or handling station.

Drying of the frozen powder is accomplished by microwave radiation. Two microwave generators 100 are shown, to ensure adequate coverage of the internal volume of the drying chamber 10. The generators are of available type, such as used in commercial cooking installations, the operation being well known. Each microwave generator 100 has a waveguide 102, which conducts energy into the drying chamber 10 through a vacuum tight and radiation transparent window 104 in wall 90. As the frozen powder moves through the drying chamber on the conveyor belts, it is heated evenly throughout by the microwave radiation. However, the heating is not sufficient to melt the frozen material and is not allowed to reach that stage. The water content of the frozen material sublines as a cold vapor and is drawn off by the vacuum pump. Due to the continuous effect of the microwave radiation, the water vapor does not settle on the walls and other structure to form frost, as in some types of freeze drying processes. The chamber and conveyor structure remain cool and clean for prolonged periods of operation. In actual operation the microwave generators would be controlled by a variable output control 105 to suit the product being treated. The control can be in the form of a timed switch to turn the microwave power on and off in any suitable duty cycle, such as 5 seconds on and 5 seconds off.

To confine the microwave radiation to the drying chamber, the collection conveyor 84 passes through a microwave choke 106. In the configuration shown, the choke 106 is in the form of a frame fitting around conveyor 84 and extending from slot 88 into the collection chamber 14. In the inside of the choke frame are spaced, circumferential slotted channels 108 which have a depth of one half wavelength of the particular microwave energy, and effectively short circuit the radiation. The basic principles of such a choke are well known and the specific configuration and slot arrangement may vary.

It has been found that the dried product is still reasonably cold when leaving the collection chamber. The water sublines as a cold vapor and heating is insufficient to separate any volatile constituents which may be essential to preserve the natural characteristics of the product. This is very important with many foodstuffs which can lose flavor when dried by direct heat, or subjected to other techniques of preservation. For example, one particularly difficult product to be preserved is fresh pineapple juice, which is usually pasteurized or frozen for storage and shipping. Much of the flavor is lost in either process and the end product is not comparable to the original. By utilizing the present microwave process, only the water is removed and the reconstituted product has been found to be almost indistinguishable from fresh juice.

Many other food products such as juice, tea, coffee, milk, flavoring extracts and the like can be freeze dried successfully by the microwave technique. In the frozen condition, bacterial growth and ensymatic action are subdued and are also retarded in the fully dried condition of the end product. The apparatus is easily adjusted for a variety of products. The pump 62 controls the rate at which frozen powder is deposited on the conveyors, and the conveyor speed and microwave energy can be adjusted to ensure that drying is just completed as the product leaves the drying chamber.

Since the microwave energy does not heat the structure of the apparatus, it is a simple matter to maintain the drying chamber at a low temperature. The product particles are heated from the inside out by the microwave radiation and do not exceed about 90° F, the moisture being removed by sublimation at well below the boiling point of water. When the moisture content is removed the particles are immediately cooled by the freezing conditions in the drying chamber, and there is no time for the relatively low heating effect to cause any chemical or physical reaction in the product. The microwave power is pulsed or otherwise controlled to perform the sublimation without excessively heating the product.

The continuous production capability of the system can be furthered by utilizing a microwave generator 110 on the heat exchanger 42, to dispose of the water condensed from the extracted vapor. Normally the water will condense and build up as ice on coils 40 and the interior walls of the heat exchanger. By using microwave radiation to melt the ice, the heat exchanger structure is not appreciably heated and the temperature balance is substantially maintained. The apparatus can thus continue to run while ice is being removed from the heat exchanger. Water collected at the bottom of the unit can be removed through drain 56 with minimum loss of vacuum. For more precisely controlled and uninterrupted flow, two similar heat exchangers could be used in parallel and one defrosted while the other is on the line.

The rapid and continuous process makes it economically feasible to freeze dry products which have previously been impractical. As a result, many products can be greatly reduced in bulk to simplify storage and transportation, and will have greatly extended shelf life.

Having described my invention, I now claim:

1. Freeze drying apparatus, comprising:

a freezing chamber with means for freezing a liquid product into powder;

a drying chamber open to and extending from said freezing chamber and subjected to the cooling therefrom;

conveyor means in said drying chamber for receiving powder from the freezing chamber and carrying the powder through the drying chamber;

a vacuum pump coupled to said drying chamber for applying a vacuum thereto;

a source of microwave radiation coupled to said drying chamber for irradiating the interior thereof;

means for controlling the microwave radiation to sublimate moisture from the powder without excessively heating the powder; and collection means for continuously extracting the dried powder product from said drying chamber.

2. Freeze drying apparatus according to claim 1, wherein said collection means includes a collection chamber attached to said drying chamber and having an opening therebetween; a collection conveyor extending through said opening from below said conveyor means; and a tuned microwave excluding choke surrounding said opening.

3. Freeze drying apparatus according to claim 2, and including a heat exchanger between said drying chamber and said vacuum pump through which vapor from the drying chamber is drawn;

a refrigeration system connected to said freezing chamber and having refrigerant conducting coils in said heat exchanger;

and a source of microwave radiation coupled to said heat exchanger to sublimate condensed moisture and prevent freezing of the moisture on said coils.

* * * * *